US006376140B1

(12) United States Patent
Friedman et al.

(10) Patent No.: US 6,376,140 B1
(45) Date of Patent: Apr. 23, 2002

(54) ELECTROSTATICALLY IMAGED PRINTING PLATE AND METHOD OF PREPARATION

(75) Inventors: Patrick R. Friedman, Bridgewater; Jian Bing Huang, Wood Ridge, both of NJ (US); Ken Shimazu, Briarcliff Manor, NY (US); Shashikant Saraiya, Parlin, NJ (US)

(73) Assignee: Kodak Polychrome Graphics LLC, Norwalk, CT (US)

( * ) Notice: Subject to any disclaimer, the term of this patent is extended or adjusted under 35 U.S.C. 154(b) by 0 days.

(21) Appl. No.: 09/706,521

(22) Filed: Nov. 3, 2000

(51) Int. Cl.[7] ..... G03G 13/26
(52) U.S. Cl. ..... 430/49; 101/457; 101/467
(58) Field of Search ..... 430/49, 124; 101/457, 101/465, 467

(56) References Cited

U.S. PATENT DOCUMENTS

| | | | | |
|---|---|---|---|---|
| 3,315,600 A | | 4/1967 | Tomanek et al. | |
| 4,271,249 A | | 6/1981 | Gillaims et al. | |
| 4,444,858 A | | 4/1984 | Nishibu et al. | |
| 4,457,992 A | | 7/1984 | Bhattacharjee et al. | |
| 4,500,618 A | * | 2/1985 | Shiba et al. | 430/124 |
| 5,141,838 A | | 8/1992 | Aoshima et al. | |
| 5,368,974 A | | 11/1994 | Walls et al. | |
| 6,014,929 A | | 1/2000 | Teng | |
| 6,025,100 A | | 2/2000 | Verschueren et al. | |
| 6,105,500 A | | 8/2000 | Bhambra et al. | |

FOREIGN PATENT DOCUMENTS

| | | |
|---|---|---|
| EP | 898205 | 2/1999 |
| EP | 901045 | 3/1999 |

* cited by examiner

*Primary Examiner*—John Goodrow
(74) *Attorney, Agent, or Firm*—Baker Botts L.L.P.

(57) ABSTRACT

A printing plate useful in lithographic printing is prepared by the process comprising:

(a) applying an alkali soluble composition comprising at least one polymer composition to a hydrophilic surface on a substrate to provide the surface face with at least one layer which is alkali soluble at a pH in the range of about 6.0 to 14.0;

(b) imaging the coated substrate electrostatically with a toner composition;

(c) heating the imaged substrate a first time to a temperature greater than the glass transition temperature of the toner composition;

(d) contacting the imaged substrate with an aqueous alkaline solution having a pH in the range of about 6.0 to about 14.0; and (e) heating the imaged substrate a second time to a temperature greater than the glass transition temperature of the toner composition.

This printing plate is capable of long runs on press with good image quality and advantageously minimizes the occurrence of undesirable background toner "specking" on press. Accordingly, the printing plate is satisfactory for demanding printing tasks such as four-color newspaper printing, financial printing and the like.

39 Claims, 1 Drawing Sheet

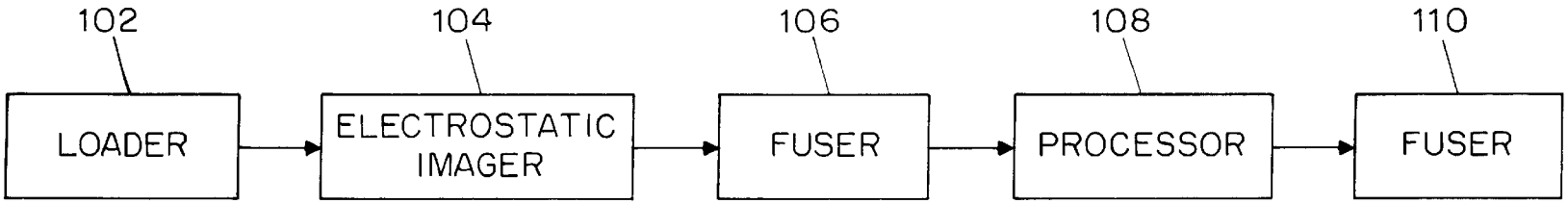
FIG. 1
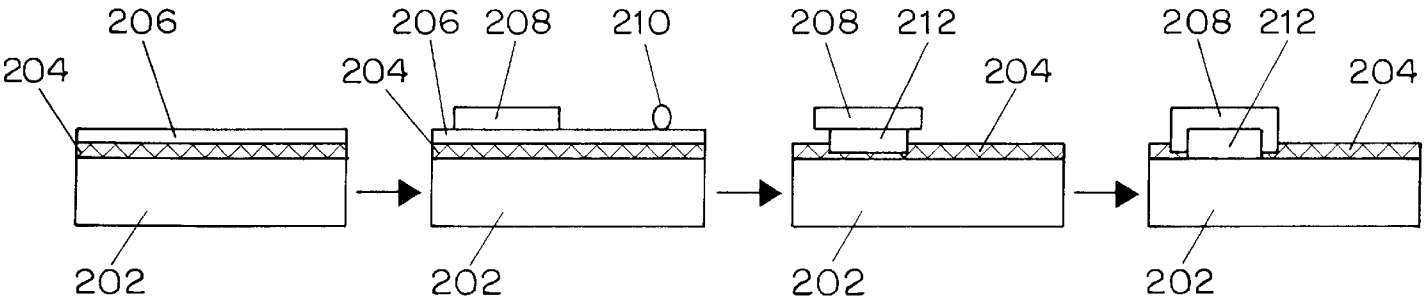
FIG. 2A
FIG. 2B
FIG. 2C
FIG. 2D
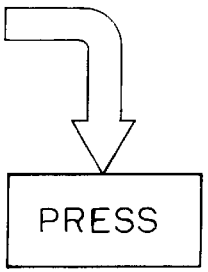
FIG. 2E

ELECTROSTATICALLY IMAGED PRINTING PLATE AND METHOD OF PREPARATION

BACKGROUND OF THE INVENTION

1. Field of the Invention

This invention relates to printing plates which are electrostatically imaged, to methods of preparing such printing plates, and to methods of printing using such printing plates. More particularly, the printing plates of this invention are prepared by applying an alkali soluble coating composition comprising at least one polymer composition to a hydrophilic surface on a substrate to provide the surface with at least one alkali soluble layer. The coated substrate is electrostatically imaged using a toner composition which is applied to the alkali soluble layer. The imaged substrate is heated a first time to fuse the toner composition to the alkali soluble layer, thereby protecting the underlying alkali soluble layer from subsequent contacting with developer solution in the imaged areas. The imaged plate is thereafter contacted with an aqueous alkali solution to remove undesired toner composition and the non-imaged portion of the alkali soluble layer which is unprotected by the fused toner composition, and the imaged plate is thereafter heated a second time to fix the remaining toner and underlying alkali soluble layer to the substrate.

2. Background Information

The manufacture of printing plates, including printing plates used in lithographic printing processes, using electrostatic imaging techniques is well known in the art. In such methods, the fixed toner images are the olephilic ink receptive portions of the plate, and upon contact of the plate with an appropriate ink or ink-containing solution, the desired ink image may be transferred, or "offset," from the plate to an appropriate medium, such as a rubber blanket, which is then used to print onto a medium such as paper. Examples of methods of preparing printing plates which are electrostatically imaged include:

U.S. Pat. No. 3,315,600, which discloses a method for preparing a printing plate in which a support having a hydrophilic surface is provided with a covering layer, the covering layer is electrostatically imaged using a toner composition, the image is fused or fixed via heating, and the covering layer is removed from the non-imaged areas by means of an aqueous solvent. However, unlike the invention described herein, only a single heating step is employed to fix the toner image to the coated support.

U.S. Pat. No. 4,444,858, which discloses a method of preparing a lithographic printing plate in which a metal substrate is coated with a synthetic resin layer, and a toner image formed on a photosensitive sheet by an electrophotographic process is transferred and fixed to the synthetic resin layer. A solvent is used to remove the non-imaged areas of the resin layer, which are not covered by the fixed toner image. However, unlike the invention described herein, the remaining toner layer which makes up the image area is used as a mask and thereafter removed to expose the insoluble imaged portion of the synthetic resin layer. In addition, unlike the present invention, no second heating or fusing step is disclosed.

U.S. Pat. No. 4,457,992, which discloses an etchable electrophotographic printing plate comprising an electroconductive support coated with a light-sensitive photoconductive zinc oxide and a sensitizing dye dispersed in an organic resin binder. Such plates are typically referred to as "organic photoconductor" or "OPC" plates. The coating is applied to the substrate as a thin film (i.e. about 5–50 $\mu$m), and dried to remove substantially all of the solvent. The resulting plate may be imaged with electrostatic toner, and the non-imaged portions of the coating are removed via a basic aqueous solution. The plate may thereafter optionally be heated to enhance plate endurance. However, unlike the invention described herein, the coating requires light-sensitive photoconductive zinc oxide to be used. In contrast, in the present invention, no light-sensitive photoconductive coating is applied to the hydrophilic surface.

U.S. Pat. No. 6,025,100, which discloses a printing plate prepared by transferring a toner image to an image receiving element which is a support having an image receiving layer thereon. The layer contains a hydrophilic binder, $TiO_2$ particles, and a matting agent, and the layer is cross-linked with hydrolyzed tetramethyl silicate or hydrolyzed tetraethylsilicate. However, unlike the invention described herein, there is no disclosure of a second heating or fusing of the toner to the imaged receiving element to fix the remaining toner and underlying alkali soluble layer in the imaged areas.

Lithographic printing plates having an imageable layer overlaid upon an intermediate layer applied to a substrate are also known. For example, U.S. Pat. No. 6,014,929 discloses a lithographic plate having a rough substrate, a releasable interlayer applied to the rough substrate surface, and a radiation-sensitive layer applied to the interlayer. However, unlike the invention described herein, there is no disclosure of the use of two separate heating or fusing steps with electrostatic imaging.

However, electrostatically imaged printing plates are known to have several disadvantages. For example, such plates are typically limited to uses for low quality printing and single color printing, due to limitations associated with imaging resolution, image width, imaging speed and unwanted background toning in non-imaged areas of the plate. Unwanted background toning on the plate substrate due to uncontrolled application of toner causes the printing of an undesirable toned background on press which limits the quality and utility of electrostatic imaging of printing plates. This unwanted phenomenon is commonly referred to as "specking" due to the formation of undesired specks in the background of the printed medium.

Several attempts have been made in the art to overcome the problem of unwanted background toning or specking. For example, the use of OPC plates with liquid toners has been attempted, but such systems are typically capable of only low-resolution imaging, and in addition are expensive and have environmental restrictions. Cleaning solutions for flexible base plates have also been employed to scrub the plate background area and remove unwanted background toner, but this method is highly operator-dependent and often results in damage to the imaged area of the plate.

In view of the foregoing, it would be advantageous to employ electrostatic imaging of a printing plate in such a manner as to minimize or eliminate undesired background toning, and simultaneously avoid the use of OPC plates and cleaning solutions. It is one object of this invention to provide an electrostatically imaged printing plate which is capable of high quality and multi-color printing. It is another object of this invention to provide a method of preparing such a printing plate. It is yet another object of this invention to provide a method of printing using such a printing plate. The printing plate of this invention advantageously avoids the above-described disadvantages of OPC plates and the use of cleaning solutions. The printing plate of this invention also advantageously may be employed for high quality printing applications such as four-color newspaper printing, book printing, financial and other small format printing, and the like, where such quality printing requires the minimization or elimination of undesired background toning and unwanted specking on the printed medium. The printing plate of this invention is also capable of long print run lengths (i.e. run lengths greater than say 150,000).

SUMMARY OF THE INVENTION

A printing plate is prepared by the process comprising:

(a) applying an alkali soluble composition comprising at least one polymer composition to a hydrophilic surface on a substrate to provide the surface with at least one layer which is alkali soluble at a pH in the range of about 6.0 to 14.0;

(b) imaging the coated substrate electrostatically with a toner composition;

(c) heating the imaged substrate a first time to a temperature greater than the glass transition temperature of the toner composition;

(d) contacting the imaged substrate with an aqueous alkaline solution having a pH in the range of about 6.0 to about 14.0; and (e) heating the imaged substrate a second time to a temperature greater than the glass transition temperature of the toner composition.

In a preferred embodiment, the substrate is an aluminum substrate having at least one hydrophilic surface which receives the coating composition. The polymer composition may be an acrylic resin. The coating may additionally comprise a cross-linking composition, such as a titanium complex. The total coating weight is in the range of 0.2–3 g/m$^2$, more preferably 0.5–3 g/m$^2$. The electrostatically applied and fused toner is preferably insoluble in an alkali solution in comparison to the polymer composition employed in this invention. The printing plate of this invention is capable of long runs on press with good image quality and advantageously minimizes the occurrence of undesirable background toner "specking" on press. Accordingly, the printing plate is satisfactory for demanding printing tasks such as four-color newspaper printing, financial printing and the like.

BRIEF DESCRIPTION OF THE DRAWINGS

FIG. 1 schematically depicts the overall process configuration for the preparation of a printing plate in accordance with this invention.

FIG. 2 schematically depicts various process steps and possible mechanisms associated with the preparation and use of a printing plate of this invention.

DETAILED DESCRIPTION OF THE INVENTION

This invention is directed primarily to lithographic printing plates and their preparation and use. Conventional printing plate substrates such as aluminum, polymeric film, and paper may be used as the printing plate substrate in all aspects of this invention. As discussed further herein, it is only necessary that the substrate be provided with a hydrophilic surface capable of accepting at least one alkali soluble layer obtained by applying the alkali soluble composition to that surface. The surface may be a surface of the substrate itself, or a hydrophilic surface applied to the underlying substrate surface.

In various preferred embodiments, the printing plate substrate used in this invention may be subjected to treatments such as electrograining, anodization, and silication to enhance its surface characteristics. The surface characteristics that are modified by such treatments are roughness, topology, and the nature and quantity of surface chemical sites.

Exemplary aluminum substrates that can be employed in all aspects of this invention are given in Table 1. Substrates chosen for use in this invention are preferably based on aluminum oxide, and may be subjected to various conventional surface treatments as are well known to those skilled in the art. These treatments also result in different surface roughness, topology, and surface chemical sites, as summarized in Table 1.

TABLE 1

Exemplary Aluminum Substrates for Printing Plate

| Substrate name | Surface Treatment | Interlayer Treatment | Surface Property |
|---|---|---|---|
| AA | Quartz Grained and Anodized | None | Acidic |
| EG-PVPA | Electrograined and Anodized | Polyvinyl phosphoric acid | Acidic |
| PF | Electrograined and Anodized | Sodium dihydrogen phosphate/Sodium fluoride | Acidic |
| G20 | Electrograined and Anodized | Vinylphosphonic acid/acrylamide copolymer | Acidic/ Amphoteric |
| CHB-PVPA | Chemically grained Basic etched | Polyvinyl phosphoric acid | Acidic |
| PG-PVPA | Pumice-grained | Polyvinyl phosphoric acid | Acidic |
| EG-Sil | Electrograined and Anodized | Sodium Silicate | Basic |
| DS-Sil | Chemically Grained and Anodized | Sodium Silicate | Basic |
| PG-Sil | Pumice Grained and Anodized | Sodium Silicate | Basic |
| CHB-Sil | Chemically Grained, Anodized and Silicated | Sodium Silicate | Basic |

"AA" means "as anodized." The aluminum surface is first quartz grained and then anodized using DC current of about 8 A/cm$^2$ for 30 seconds in a $H_2SO_4$ solution (280 g/liter) at 30° C.

"EG" means "electrolytic graining." The aluminum surface is first degreased, etched and subjected to a desmut step (removal of reaction products of aluminum and the etchant). The plate is then electrolytically grained using an AC current of 30–60 A/cm$^2$ in a hydrochloric acid solution (10 g/liter) for 30 seconds at 25° C., followed by a post-etching alkaline wash and a desmut step. The grained plate is then anodized using DC current of about 8 A/cm$^2$ for 30 seconds in a $H_2SO_4$ solution (280 g/liter) at 30° C.

"PVPA" is a polyvinylphosphonic acid. The plate is immersed in a PVPA solution and then washed with deionized water and dried at room temperature.

"DS" means "double sided smooth." The aluminum oxide plate is first degreased, etched or chemically grained, and subjected to a desmut step. The smooth plate is then anodized.

"Sil" means the anodized plate is immersed in a sodium silicate solution (80 g/liter), commercially available under the trademark N-38 from the Philadelphia Quartz Co. at 75° C. for one minute. The coated plate is then rinsed with deionized water and dried at room temperature.

"PG" means "pumice grained." The aluminum surface is first degreased, etched and subjected to a desmut step. The plate is then mechanically grained by subjecting it to a 30% pumice slurry at 30° C., followed by a post-etching step and a desmut step. The grained plate is then anodized using DC current of about 8 A/cm$^2$ for 30 seconds in an $H_2SO_4$ solution (280 g/liter) at 30° C. The anodized plate is then coated with an interlayer.

"G20" is a printing plate substrate which is described in U.S. Pat. No. 5,368,974, the disclosure of which is incorporated herein by reference in its entirety.

"CHB" means chemical graining in a basic solution. After an aluminum substrate is subjected to a matte finishing process, a solution of 50 to 100 g/liter NaOH is used during graining at 50 to 70° C. for 1 minute. The grained plate is then anodized using DC current of about 8 A/cm$^2$ for 30 seconds in an $H_2SO_4$ solution (280 g/liter) at 30° C. The anodized plate is then coated with a silicated interlayer.

"PF" substrate has a phosphate fluoride interlayer. The process solution contains sodium dihydrogen phosphate and sodium fluoride. The anodized substrate is treated in the solution at 70° C. for a dwell time of 60 seconds, followed by a water rinse, and drying. The deposited dihydrogen phosphate is about 500 mg/m$^2$.

A "basic" surface will have a plurality of basic sites and acidic sites present, with the basic sites predominating to some degree. Similarly, an "acidic" surface will have a plurality of acidic sites and basic sites present, with the acidic sites predominating to some degree. It is known by one of ordinary skill in the art that the PG-Sil printing plate substrate appears to have a higher silicate site density than the DS-Sil printing plate substrate, and is more basic. It is also known that the G20 printing plate substrate exhibits less acidic character than AA printing plate substrates.

In one preferred embodiment of this invention, the substrate itself must have at least one hydrophilic surface. If the substrate used does not initially have at least one hydrophilic surface, the surface of the substrate may be treated to render it hydrophilic as set forth above with respect to various preferred embodiments. This may be accomplished by methods well known to those skilled in the art. For example, in one preferred embodiment the substrate employed is hydrophilized with PVPA. In another preferred embodiment, the substrate is hydrophilized with silicate. Such hydrophilization of the substrate surface may be accomplished via other techniques well known in the art. In yet another preferred embodiment, a surface of the substrate is first coated with a hydrophilic layer by contacting the substrate surface with a liquid comprising a silicate solution in which particulate material is dispersed, as disclosed, for example, in U.S. Pat. No. 6,105,500, which is incorporated herein by reference in its entirety. As disclosed in U.S. Pat. No. 6,105,500, the silicate solution may comprise one or more, but preferably only one, metal or non-metal silicate. Such metal silicates may be alkali metal silicates, and such non-metal silicates may be quaternary ammonium silicates. The particulate may be an organic or inorganic material. Organic particulate materials may be provided by latexes. Inorganic particulate materials may be selected from alumina, silica, silicon carbide, zinc sulphide, zirconia, barium sulphate, talcs, clays (e.g. kaolin), lithopone and titanium oxide.

Once the hydrophilic surface on the substrate is provided (i.e. either the hydrophilic substrate surface itself or the hydrophilic layer applied to the substrate), the surface is coated with an alkali soluble composition comprising at least one polymer composition component to provide the hydrophilic surface with at least one layer which is alkali soluble at a pH in the range of about 6.0 to about 14.0. Alkali soluble compositions are well known to those skilled in the art. Such alkali soluble compositions which may be used in this invention include, without limitation, acrylic compositions (including acrylic resins, copolymers and terpolymers), phenolic compositions, urethane-urea compositions (including polyurethanes), phenolic-acrylic compositions, and variations and mixtures thereof. Such alkali soluble compositions preferably have an average molecular weight in the range of about 8000–50,000, more preferably from about 10,000–30,000, most preferably from about 15,000–25,000. The acrylic terpolymers, if employed, preferably have an acid number (AN) in the range of about 10–200, preferably 50–125, most preferably about 90–95.

In one particularly preferred embodiment, poly(4-vinylphenol) is employed as a polymer composition component of the alkali soluble coating composition. In another particularly preferred embodiment, an acrylic terpolymer Polymer I) having an AN of about 90 which is chain polymerized from ethyl acrylate (EA), methyl methacrylate (MMA) and methyl acrylic acid (MAA) is employed as a polymer composition component of the alkali soluble coating composition. In a preferred embodiment, Polymer I has a EA:MMA:MAA mole % ratio of 9.8:74.9:15.3.

In another particularly preferred embodiment a polyurethane resin (Polymer II) is employed as a polymer composition component of the alkali soluble coating composition. Polymer II is preferably a polyurethane resin based on acrylonitrile (ACN)/methyl methacrylate (MMA)/amino sulfonylphenyl-methacrylamide (ASPM), such as disclosed in U.S. Pat. No. 5,141,838, which is incorporated herein by reference in its entirety. U.S. Pat. No. 5,141,838 specifically discloses a Polymer II-type polyurethane resin having a ACN:MMA:ASPM mole % ratio of 32:41:27 (see Table 1, compound (d) therein), which may be used as the polyurethane resin component herein. The polyurethane component may be synthesized, for example, as described in U.S. Pat. No. 5,141,838 "Synthesis Example 2" at col. 18, line 58–col. 20, line 4, except that MMA is substituted for EA therein. In a particularly preferred embodiment, Polymer II is a polyurethane resin having a ACN:MMA:ASPM mole % ratio of 24:42:34.

In another particularly preferred embodiment, the combination of a polyurethane resin such as Polymer II and an acrylic terpolymer is employed as a polymer composition component of the alkali soluble coating composition. In a preferred embodiment, the acrylic terpolymer is a terpolymer (Polymer III) of methyl acrylic acid (MAA), n-phenylmaleimide (NPM) and methacrylamide (MAAM) having an AN of about 95. In a particularly preferred embodiment, Polymer III has a MAA:NPM:MAAM mole % ratio of 25:40:35. The synthesis and/or structures of these compounds are set forth below:

Polymer I:

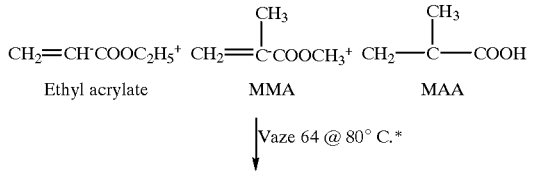

-continued

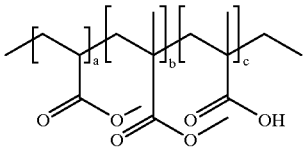

where a = 5–20, b = 50–85, c = 5–25

Polymer II:

Polyurethane

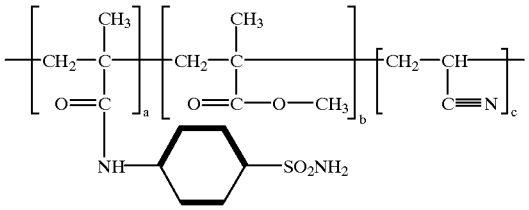

where a = 15–35, b = 25–70, c = 25–50

Polymer III:

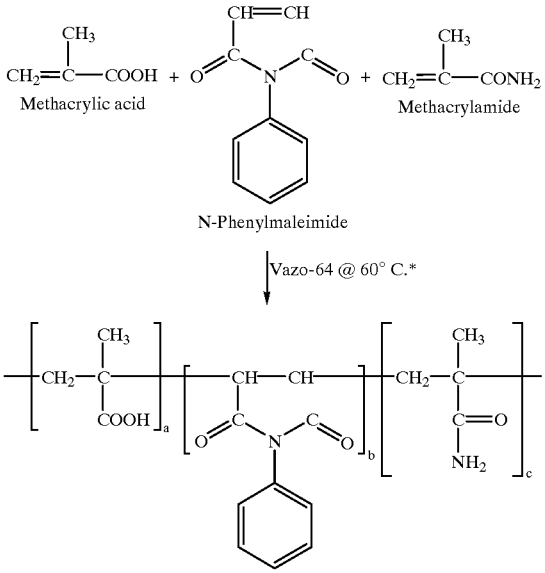

where a = 5–35, b = 30–50, c = 25–45

(Vazo 64 is 2-2'-azo bis(2-methylpropane nitrile), available from E. I. DuPont de Nemours & Co.)

The coating composition may additionally comprise at least one cross-linking moiety or polymerizable composition, as will be well understood by those skilled in the art. Cross-linking compositions particularly preferred for use in the coating composition include titanium complexes such as TYZOR AA-75 (a titanate available from DuPont). Other cross-linking compositions suitable for use include hydrolysed tetramethyl orthosilicate, hydrolysed tetraethyl orthosilicate, diisocyanates, bisepoxides, formaldehyde, melamine formol, methylol ureum, and zirconate compounds.

The coating composition may additionally comprise at least one contrast dye. Suitable dyes which optionally may be used in the coating composition are those which are easy to dissolve in the solvent or solvent mixture used in the coating or which can be introduced as pigment in dispersed form. Suitable contrast dyes are, for example, rhodamine dyes, methyl violet, anthraquinone pigments and phthalocyanine dyes or pigments, the series of triarylmethane dyes (such as Victoria Blue BO, Victoria Blue R, crystal violet) or diazo dyes (such as 4-phenylazodiphenylamine, azobenzene or 4-N,N-dimethylaminoazobenzene). Preferably, the dyes are present in the coating composition in an amount of 0.01 to 10 weight %, with about 0.1 to 5 weight % being particularly preferred.

Any suitable solvent for application of the polymer composition known to those skilled in the art may be used in preparing the coating composition. Particularly preferred solvents for use are 2-methoxyethanol and methyl cellusolve. Other solvents suitable for use include ethanol, methyl ethyl ketone, toluene, DOWANOL (a product of the Dow Chemical Co.), and water. The choice of solvent is dependent upon the particular components of the coating composition, as will be well understood by those skilled in the art.

In one particularly preferred embodiment, the coating solution is prepared by admixing poly(4-vinylphenol), a cross-linking composition and a dye at weight ratios of 80:15:5, preferably 79:17:4 (poly(4-vinylphenol):cross-linker:dye) in the presence of a suitable solvent. In such an embodiment, the coating solution may have a solids content of about 0.5 to 5%, preferably about 0.5 to 2%.

In another particularly preferred embodiment, an acrylic terpolymer having an AN of 90–95 is dissolved in a suitable solvent such that the solids content of the resulting coating solution is about 1 to 5%.

In yet another particularly preferred embodiment, an acrylic terpolymer having an AN of 90–95 is used alone or admixed with a polyurethane resin in a weight ratio of about 99:1 to 60:40 (acrylic terpolymer:polyurethane) in a suitable solvent.

After the coating solution is prepared, it may be applied to the hydrophilic substrate surface via methods well known to those skilled in the art, such as in-line hopper coating, bar coating, curtain coating, extrusion coating, pan coating, whirl coating, brushing and the like, and dried at temperatures in the range of 60–120° C. The coating, once applied, provides the substrate with at least one layer which is alkali soluble at a pH in the range of about 6.0 to about 14.0. The coating weight, once applied to the substrate, should be in the range of 0.2–3 g/m$^2$, more preferably 0.5–3 g/m$^2$.

The coated substrate face is imaged electrostatically using a toner composition. As discussed above, electrostatic imaging techniques are well known to those skilled in the art, as exemplified by U.S. Pat. Nos. 3,315,600; 4,444,858; and 6,025,100, the disclosures of which are all incorporated herein by reference. For example, the toner composition image may be received by the alkali soluble layer using direct transfer from an OPC drum or belt, or using indirect transfer from a belt or drum that transfers the image from the OPC drum or belt to the alkali soluble layer. It will be understood by those skilled in the art that the purpose of this electrostatic imaging is to transfer the desired image and information contained therein from the information source (e.g. a computer or the like) to the alkali soluble layer by digital or analog means for inclusion in the printing plate of this invention. In this invention, the alkali soluble layer residing on the substrate acts as a barrier and prevents any contact or physical interaction between the toner composition and the substrate during the imaging process. Undesired or stray toner composition may reside on the non-imaged portions of the coated substrate. It is the ultimate elimination of these undesired toner composition areas that is a principal advantage of the printing plate and method of this invention.

Conventional toner compositions, as are well known in the art, may be used to image the coated substrate face, so long as the toner composition has a glass transition temperature (Tg) lower than the temperature employed in the first and second heating steps employed in this invention. Toner compositions suitable for use in photocopiers, laser printers and the like are suitable for use as the toner composition in the present invention and are preferred. Further information about toner compositions may be found, for example, in U.S. Pat. No. 4,271,249, EP 901045 and EP 898205, all of which are incorporated herein by reference in their entirety. In one embodiment of this invention, the toner composition used is photocopier toner comprising carbon black surrounded by a layer of styrene-acrylic or styrene-butadiene resin, and the toner composition has a Tg in the range of 70–90° C. In another preferred embodiment of this invention, cyan toner compositions comprising a PET polymer and having Tg in the range of 75–85° C. are particularly preferred.

After the coated substrate face is imaged, the imaged substrate is heated a first time at a temperature greater than the Tg of the toner composition. The primary purpose of this initial heating is to cause the image created by the toner to adhere or fuse to the alkali soluble layer provided by the coating. For example, this initial heating may be accomplished by techniques such as contact or non-contact fusing, as are well known to those skilled in the art. Again, the alkali soluble layer prevents any contact or physical interaction between the toner composition and the substrate at this point.

The imaged substrate is thereafter contacted with an aqueous alkaline solution having a pH in the range of about 6.0 to about 14.0. The use of such solutions as developers for lithographic printing plates and the like is well known to those skilled in the art. Aqueous alkaline solutions suitable for use include MX-1710 and ND-956 developer solutions available from Kodak Polychrome Graphics. The purpose of this contacting is to wash off the non-imaged portion of the alkali soluble layer, which is unprotected by the fused toner composition, and any undesired material residing on the alkali soluble layer or elsewhere on the substrate, such as stray toner composition particles, polymeric coatings and the like which are not desirable in the non-imaged areas of the substrate. However, the desired imaged portion, which includes the toner composition residing upon the underlying portion of the alkali soluble layer are not removed by contacting with the aqueous alkaline solution. This contacting may be accomplished via conventional printing plate processors which are well known to those skilled in the art.

The resulting imaged substrate is thereafter heated a second time at a temperature greater than the Tg of the toner composition. The primary purpose of this second heating step is to cause the image created by the toner to fix the remaining toner and underlying alkali soluble layer to the substrate. As with respect to the initial heating, this second heating may be accomplished by techniques such as contact or non-contact fusing, as are well known to those skilled in the art. After this second heating, the imaged plate may be gummed, if desired, and used on press for lithographic printing and the like.

Without wishing to be bound by any one theory, it is believed that during the second heating step, the remaining toner and alkali soluble layer may merge, which is believed to cause decreased solubility of the remaining imaged portion and improve press wear characteristics of the plate. The second heating step may also "bake" or crosslink the underlying alkali soluble layer, thereby rendering that layer less soluble and improve the press wear of the plate.

Typically actual printing is achieved by placing the imaged printing plate of this invention in a printing press, contacting the plate with an ink, thereby causing the ink to adhere to the oleophilic imaged portion of the plate, and thereafter transferring imagewise the ink from the printing plate to a receiving material such as a rubber blanket or the like, as is well known to those skilled in the art, for eventual transfer of the inked image to newspaper, books or other printed media.

This invention may further be understood by reference to FIGS. 1 and 2, which will be understood by those skilled in the art to be illustrative of various features of this invention. In FIG. 1, an overall schematic of the method of preparing the plate of this invention is provided. The loader 102 loads the substrate having at least one alkali soluble layer into the electrostatic imager 104, which images the coated substrate electrostatically with the toner composition. The imaged plate is thereafter further processed in the fuser 106, where the imaged substrate is heated a first time to a temperature greater than the Tg of the toner. The imaged plate is then transferred to the processor 108 where the imaged substrate is contacted with an aqueous alkaline solution such as a developer solution having a pH in the range of about 6.0 to about 14.0 to remove from the substrate the portion of the alkali soluble layer which is not protected by the fused toner as well as to remove stray background toner from the imaged substrate. The developed imaged substrate is thereafter further processed in the fuser 110 (which may be the same or different from fuser 106), where the imaged substrate is heated a second time to a temperature greater than the Tg of the toner to fix the remaining toner composition and underlying alkali soluble layer in the imaged areas, thereby improving the durability of the plate in terms of image adhesion on the press. Subsequent to the second heating, the imaged substrate (now a printing plate) may be further processed or handled as necessary for installation on the press. For example, the plate may be further processed by a punch and/or bender (not shown) to accommodate the plate for press installation.

In FIG. 2, one embodiment of the method of preparation of the printing plate of this invention (labeled FIGS. 2A through 2E) and possible mechanisms associated with the preparation and use of the printing plate and method of this invention are set forth. As depicted in FIG. 2A, the substrate 202 has a hydrophilic face 204. A coating composition comprising at least one polymer composition (e.g. acrylic resin) has been applied to the hydrophilic face 204 to provide a layer 6 which is alkali soluble at a pH in the range of about 6.0 to 14.0.

FIG. 2B depicts the printing plate precursor of FIG. 2A after it has been imaged electrostatically with a toner composition, and the imaged precursor has been heated a first time to a temperature greater than the Tg of the toner composition. The desired image created by the toner composition is represented by toner imaged portion 208, whereas, for illustrative purposes, undesired or stray toner 210 is shown residing on the non-imaged portions of the layer 206. Without wishing to be bound by any one theory, it is believed that the imaged portion 208 of the toner composition adheres or fuses to the alkali soluble layer 206, which acts as a barrier at this point and prevents any physical interaction or contact between the imaged portion 208 or stray portion 210 of the toner composition and the substrate 202, as well as decreasing the solubility of the remaining alkali soluble layer underlying the toner composition, as discussed above.

FIG. 2C depicts the imaged substrate after it has been contacted with an aqueous alkaline solution having a pH in the range of about 6.0 to about 14.0. As depicted in FIG. 2C, the non-imaged portion of layer 206 has been removed together with the undesired stray portion 210 of the toner residing on layer 206 via contacting with the aqueous alkaline solution. The desired image portion 208 of the toner composition is not removed by contacting with the aqueous alkaline solution. Without wishing to be bound by any one theory, it is believed that, in the process of removing the non-imaged portion of layer 206, the aqueous alkaline solution causes the undercutting of that portion of layer 206 that resides under the toner imaged portion 208. The undercut layer portion 212 remains to support image portion 208 of the toner composition.

FIG. 2D depicts the imaged substrate after it has been heated a second time to a temperature greater than the Tg of the toner composition. Without wishing to be bound by any one theory, it is believed that the heated imaged portion 208 of the toner composition seals the underlying layer portion 212 by flowing around the undercut layer portion 212, although the imaged portion 208 of the toner composition may also admix to some extent with the underlying layer portion 212. It is also believed that, at this point, the imaged portion 208 of the toner composition directly contacts the surface 204 of substrate 202, and that chemical or physical interactions, or both, cause the imaged portion 208 of the toner composition to fuse or adhere to surface 204 and seal the underlying layer portion 212. It is believed that it is this interaction that provides the resulting printing plate with enhanced image durability on press.

The resulting printing plate may be gummed, if desired (not shown) and may be used on press, as shown in FIG. 2E. The plate has enhanced image quality, with significant reduction or elimination of background toner specking on press, and good image durability on press.

The invention is exemplified by, but not limited to, the following examples.

EXAMPLE 1

Solutions of 0.5% solid (sample A), 1% solid (sample B) and 2% solid (sample C) of a mixture of poly(4-vinylphenol) having a molecular weight (MW) of 20,000 and a glass transition temperature (Tg) of 151° C., TIZOR AA-75 (a titanium complex cross-linker available from Dupont) and Victoria Pure Blue BO dye at w/w ratios of 79:17:4 were prepared by dissolving in 2-methoxyethanol. The solutions were then coated onto an aluminum substrate employing a whirl coater at 70 RPM and dried at 120° F. for three minutes. The substrate was an EG substrate, hydrophilized with PVPA. The resulting coating weights were determined gravimetrically as 0.07 (for sample A), 0.24 g/m$^2$ (for sample B) and 0.4–0.5 g/m$^2$ (for sample C) respectively. The % solution coating weight relationship for the poly(4-vinylphenol) may be described by the equation coating weight (CW)=0.254 x−0.112 where x=% solid. Two samples of each coated substrate and a blank non-coated control were then imaged on a QMS Magicolor 330 laser printer employing a cyan toner that comprised a PET polymer toner with a Tg=81° C. A standard digital target was employed which contained imbedded GATF targets, text writing and a half-tone variable dot image at 1200 dpi and 100 lpi. The contact fuser in the engine was disabled and all samples were heated in a radiant oven at 130° C. for 30 seconds.

All the samples were then passed through a Polychrome PC-16 processor containing a standard Kodak Polychrome Graphics MX-1710 developer at 80–85° F., a pH of 13.7 and a processing speed setting of 5. One sample of A, B and C (referred to herein as A2, B2 and C2 respectively) and a blank control were then subjected to a second heating at a temperature greater than the Tg of the toner. The plate samples were then put onto an OMCSA press for comparison. The results are set forth in Table 2.

TABLE 2

| | Single Heating Process | | | | Double Heating Process | | | |
|---|---|---|---|---|---|---|---|---|
| Sample | Control | A | B | C | Control | A2 | B2 | C2 |
| Number of times fused | 1 | 1 | 1 | 1 | 2 | 2 | 2 | 2 |
| Image adhesion in processor | 1 | 1 | 1 | 10 | 1 | 1 | 1 | 10 |
| Image adhesion on press (@ 2000 prints) | 1 | 7 | 10 | 10 | 1 | 2 | 3 | 8 |
| Background specking $D_{R\ Cyan}$ | 0.12 | 0.10 | 0.09 | 0.1 | 0.12 | 0.12 | 0.10 | .09 |

In Table 2, the following rating system was employed:
1 = Excellent
5 = Good
10 = Poor The descriptions further describe the information summarized in Table 2 as follows:

| | |
|---|---|
| Number of Times fused | Describes if the plate sample was heated only before processing (heated once) or if the sample received a second post-processing heating (heated twice) |
| Image Adhesion in Processor | A subjective rated response of the effect of processing in a plate processor to the quality of the image. Critical responses were the holding of the 3, 4 and 5% dots, the quality of the 42.4 μline, and the completeness of the circle in the GATF Target. A poor rating indicated that the image was removed in the processor. |
| Image Adhesion on Press | A rated response of the effect of printing to the quality of the image. Critical responses were the holding of the 3, 4 and 5% dots, the quality of the 42.4 μline, and the completeness of the circle in the GATF Target. A poor rating indicated that the printing process removed the image within 2000 impressions. |
| Background Specking | Measured the amount of unwanted ink transferred from the stray toner on the plate to the paper. This was a comparison of the reflection reading of the Cyan ink employed on the press to the background of the paper. The measurements were made with an X-Rite 418-color reflection densitometer. The blank non-printed paper density was measured at 0.09 A Δ Background specking $D_{R\ Cyan}$ of ±0.02 was a significant visual difference easily perceived by the eye. |

As set forth in Table 2, it can be seen that plates A2 and B2 both demonstrated excellent image adhesion in the processor, and acceptable image adhesion on press. Plates B2 and C2 also demonstrated improved background specking. Plate B2 is a particularly preferred embodiment of this invention, and demonstrated that the effectiveness of the invention for this particular coated plate appeared to have an optimum with respect to coating weight and the type of resin system used, with sample B2 having an optimum coating weight of about 0.24 g/m$^2$.

EXAMPLE 2A

Solutions of 0.5% solids (sample A), 1% solids (sample B) and 1.5% solids (sample C) of a mixture of poly(4-vinylphenol) having a MW=20,000 and Tg=151° C., TYZOR AA-75 and Victoria Pure Blue BO dye at w/w ratios of 79:17:4 were prepared by dissolving in 2-methoxyethanol (MC). The solutions were then coated onto an aluminum substrate employing a whirl coater at 70 RPM and dried at 120° F. for three minutes. The substrate was a pumice-grained substrate hydrophilized with silicate. The coating weights ranged from 0.07 to 0.5 g/m$^2$. Two samples of each coated substrate and a blank non-coated control were then imaged on a QMS Magicolor 330 laser printer employing a cyan toner that comprises a PET polymer toner with a Tg=81° C. A standard digital target was employed which contained imbedded GATF targets, text writing and a half-tone variable dot image at 1200 dpi and 100 lpi. The contact fuser in the engine was disabled and all samples were heated in a radiant oven at 130° C. for 30 seconds.

All the samples were then passed through a Kodak Polychrome Graphics PC-16 processor containing a standard Kodak Polychrome Graphics MX-1710 developer at 80–85° F., a pH of 13.7 and a processing speed setting of 5. One sample of each of A, B, C (referred to herein as A2, B2 and C2) and a blank control were then subjected to a second heating at a temperature greater than the Tg of the toner. The plate samples were then put onto an OMCSA press for comparison. The results are set forth in Table 3. The same rating system as in Example 1 was employed.

TABLE 3

| | Single Heating Process | | | | Double Heating Process | | | |
|---|---|---|---|---|---|---|---|---|
| Sample | Control | A | B | C | Control | A2 | B2 | C2 |
| Number of times fused | 1 | 1 | 1 | 1 | 2 | 2 | 2 | 2 |
| Image adhesion in processor | 1 | 1 | 1 | 1 | 1 | 1 | 1 | 1 |
| Image adhesion on press (@ 2000 prints) | 1 | 8 | 10 | 10 | 1 | 1 | 2 | 3 |
| Background specking $D_{R\ Cyan}$ | 0.12 | 0.09 | 0.09 | 0.09 | 0.12 | 0.10 | 0.10 | 0.09 |

As set forth in Table 3 it can be seen that embodiments of this invention (i.e. plates A2, B2 and C2) showed improved background specking compared to the control. All of the plates A2, B2 and C2 also showed excellent image adhesion in the processor, and acceptable image adhesion on press, although Sample A2 demonstrated excellent image adhesion on press. All of the inventive plates A2, B2 and C2 had backgrounds virtually free of specking from stray toner. This example also demonstrated that the effectiveness of the invention appeared to have an optimum with respect to coating weight and the type of resin system, with sample C2 having an optimum coating weight of about 0.48 g/m$^2$.

It is believed that addition of cross-linking compositions such as TYZOR AA-75 may have a detrimental effect on image quality of a plate in this invention under certain conditions. Accordingly, the following example is directed to embodiments of this invention in which the cross-linking composition is not used.

EXAMPLE 2B (Hpothetical)

Solutions of 0.5% solids (sample A), 1% solids (sample B) and 1.5% solids (sample C) are prepared as described in Example 2A, except that no TYZOR AA-75 cross-linker is used. The solutions are applied to the aluminium substrate as described in Example 2A. The coating weight of these samples are in the range of 0.6–0.8 g/m$^2$. It is believed that both the image adhesion (in processor and on press) and background specking of these samples will be acceptable.

EXAMPLE 3

Solutions of 1, 2, 3, 4 and 5% solid of an acrylic terpolymer with an AN of 90 (Polymer I) having an EA:MMA:MAA mole % ratio of about 9.8:74.9:15.3 were prepared by dissolving the solid acrylic polymer in methyl cellusolve for one hour while mixing. The solutions were then coated onto an aluminum substrate employing a whirl coater at 70 RPM and dried at 120° F. for three minutes and labeled as a, b, c, d, & e respectively. The substrate was a pumice-grained substrate hydrophilized with silicate. The coating weights range from 0.11 g/m$^2$ to 1.12 g/m$^2$ with the percent solution to coating weight relationship described by the equation $CW=21.25\ x^2+74.393\ x-91$; where x=% solid. Two samples of each coated substrate and a blank non-coated control were then imaged on a QMS Magicolor 330 laser printer employing the cyan toner as in Example 1. A standard digital target was employed which contained imbedded GATF targets, text writing and a halftone variable dot image at 1200 dpi and 100 lpi. The contact fuser in the engine was disabled and all samples were heated in a radiant oven at 130° C. for 30 seconds.

All the plate samples were then hand-processed with a standard Kodak Polychrome Graphics ND-956 negative plate developer. The technique employed was to wet the plate with developer and let stand for ten seconds. The plate was then rinsed with fresh developer and wiped with a soft cloth for 20 seconds under mild pressure, and then rinsed with water, dried, and cut in half with one half being subjected to a second heating at a temperature greater than the Tg of the toner composition. Both the single and double heated plates resulted in a good image with a clean background.

Visual evaluation under a microscopic loop of the plates showed that, as compared to the control, increasing coating thickness on the substrate dramatically improved the cleanliness of the background and decreased the number of stray toner particles left on the plate without sacrificing image quality. A clear relationship was seen where as the number of residual toner particles left on the plate was inversely proportional to the coating weight.

A comparison of the single and double fusing effects on image adhesion was checked employing a "tape test." This test was performed by applying clear adhesive tape to the surface image of the plate under hand pressure and quickly ripping the tape from the surface. The adhesive property of the tape acted as an exaggerated ink cohesive test in which adhered ink on the blanket can remove the image from the plate during printing. A failure in this test is when the tape can remove the image from the plate. Each sample was tested and showed that the plates prepared in accordance with this invention greatly improved the image adhesion to the plate to a point where all samples of this invention were equal to the non-coated fused control and all plates which employed only a single heating step failed. This test illustrated the effectiveness of the second heating step used in the preparation of the printing plate of this invention.

EXAMPLE 4

Solutions of 1, 2, 3, 4 and 5% solid of a 75/25% mixture of acrylic terpolymer (Polymer III) having a MAA:NP M:MAAM mole % ratio of about 25:40:35 with an AN value of 95 and a Tg=106° C., and a polyurethane resin (Polymer II) having a ACN:MMA:ASPM mole % ratio of about 24:42:34 with a Tg=151° C. were prepared by dissolving the solids in methyl cellusolve for one hour while mixing. The solutions were then coated onto an aluminum substrate employing a whirl coater at 70 RPM and dried at 120° F. for three minutes. The substrate was a pumice-grained substrate hydrophilized with silicate. The coating weights ranged from 110 mg/m$^2$ to 1120 mg/m$^2$ with the percent solution to coating weight relationship described by the equation CW=25.536 x $^2$+44.964 x−73; where x=% solid. Two samples of each barrier coating and a blank non-coated control were then imaged on a QMS Magicolor 330 laser printer employing the cyan toner as in Example 1. A standard digital target was employed which contained imbedded GATF targets, text writing and a halftone variable dot image at 1200 dpi and 100 lpi. The contact fuser in the engine was disabled and all samples were heated in a radiant oven at 130° C. for 30 seconds.

All the plate samples were then hand-processed with a standard Kodak Polychrome Graphics ND-956 negative plate developer. The technique employed was to wet the plate with developer and let stand for ten seconds. The plate was then rinsed with fresh developer and wiped with a soft cloth for 20 seconds under mild pressure, and then rinsed with water, dried, and cut in half with one half being subjected to a second heating at a temperature greater than the Tg of the toner composition. Both the single and double heated plates resulted in a good image with a clean background.

Visual evaluation under a microscopic loop of the plates showed that, as compared to the control, increasing coating thickness on the substrate dramatically improved the cleanliness of the background and decreased the number of stray toner particles left on the plate without sacrificing image quality. A clear relationship was seen where the number of residual toner particles left on the plate was inversely proportional to the coating weight.

A comparison of the single and double heating effects on image adhesion was checked employing the tape test described in Example 3. Each sample was tested, and the results demonstrated that the double heating of the coated substrate greatly improved the image adhesion to the plate to a point where all double heated samples were equal in terms of image adhesion to the non-coated control, and all single heated samples failed. This test illustrated the effectiveness of the second heating step used in the preparation of the printing plate of this invention.

EXAMPLE 5

Two additional plate samples were prepared and processed as described in Example 4 having solutions of 6% and 7% solids. The plates were then inspected for quality after processing. It was found that the 7% solution, which had a coating weight of about 1,840 mg/m$^2$, showed some loss of detail from the processor as a result of the high coating layer thickness. The 6% sample, which had a coating weight of about 1,430 mg/m$^2$, resulted in a plate with good image quality and showed very little remaining toner on the plate after processing. A press sample plate of the 6% solution was then prepared as described in Example 4 above. This sample was put onto press and compared to a non-coated control sample of the same silicate treated substrate. The test plate demonstrated very good printing quality with a Δ background specking $D_{R\ Cyan}$ of −0.03 from the non-coated control or essentially a $D_{min}$ equal to that of the plain paper. The press was run for 2000 impressions and showed no signs of image wear.

It should be understood that various changes and modifications to the preferred embodiments described herein will be apparent to those skilled in the art. Such changes and modifications can be made without departing from the spirit and scope of this invention and without diminishing its attendant advantages. It is therefore intended that such changes and modifications be covered by the appended claims.

We claim:

1. A printing plate prepared by a process comprising:

(a) applying an alkali soluble composition comprising at least one polymer composition to a hydrophilic surface on a substrate to provide the surface face with at least one layer which is alkali soluble at a pH in the range of about 6.0 to 14.0;

(b) imaging the coated substrate electrostatically with a toner composition;

(c) heating the imaged substrate a first time to a temperature greater than the glass transition temperature of the toner composition;

(d) contacting the imaged substrate with an aqueous alkaline solution having a pH in the range of about 6.0 to about 14.0; and (e) heating the imaged substrate a second time to a temperature greater than the glass transition temperature of the toner composition.

2. The printing plate of claim 1, in which the substrate is aluminum.

3. The printing plate of claim 2, in which the aluminum substrate is electrograined and hydrophilized.

4. The printing plate of claim 1, in which the polymer composition is selected from the group consisting of acrylic compositions, phenolic compositions, urethane-urea compositions, phenolic-acrylic compositions, and mixtures thereof.

5. The printing plate of claim 4, in which the polymer composition is selected from the group consisting of poly (4-vinylphenol), acrylic terpolymers, and polyurethane, and mixtures thereof.

6. The printing plate of claim 1, in which the alkali soluble composition additionally comprises at least one cross-linking composition.

7. The printing plate of claim 6, in which the cross-linking composition is a titanium complex.

8. The printing plate of claim 1, in which the alkali soluble composition comprises poly(4-vinylphenol) and a titanium complex cross-linking composition.

9. The printing plate of claim 1, in which the alkali soluble composition comprises at least one acrylic terpolymer.

10. The printing plate of claim 9, in which the acrylic terpolymer has an acid number in the range of about 90–95.

11. The printing plate of claim 1, in which the coating composition comprises at least one acrylic copolymer and a polyurethane resin.

12. The printing plate of claim 1, in which the layer applied to the substrate face has a total weight in the range of 0.5–3 mg/m$^2$.

13. The printing plate of claim 1, in which the alkali soluble composition is applied to a hydrophilic surface of the substrate.

14. The printing plate of claim 1, in which the substrate is first provided with a hydrophilic layer by contacting a surface of the substrate with a liquid comprising a silicate solution in which particulate matter is dispersed, and the alkali soluble composition is thereafter applied to the hydrophilic layer.

15. A method of preparing a printing plate comprising:

(a) applying an alkali soluble composition comprising at least one polymer composition to a hydrophilic surface on a substrate to provide the surface face with at least one layer which is alkali soluble at a pH in the range of about 6.0 to 14.0:

(b) imaging the coated substrate electrostatically with a toner composition;

(c) heating the imaged substrate a first time to a temperature greater than the glass transition temperature of the toner composition;

(d) contacting the imaged substrate with an aqueous alkaline solution having a pH in the range of about 6.0 to about 14.0; and (e) heating the imaged substrate a second time to a temperature greater than the glass transition temperature of the toner composition.

16. The method of claim 15, in which the substrate is aluminum.

17. The method of claim 16, in which the aluminum substrate is electrograined and hydrophilized.

18. The method of claim 15, in which the polymer composition is selected from the group consisting of acrylic compositions, phenolic compositions, urethane-urea compositions, phenolic-acrylic compositions, and mixtures thereof.

19. The method of claim 18, in which the polymer composition is selected from the group consisting of poly (4-vinylphenol), acrylic terpolymers, and polyurethane and mixtures thereof.

20. The method of claim 15, in which the alkali soluble composition comprises at least one cross-linking composition.

21. The method of claim 20, in which the cross-linking composition is a titanium complex.

22. The method of claim 15, in which the alkali soluble composition comprises poly(4-vinylphenol) and a titanium complex cross-linking composition.

23. The method of claim 15, in which the alkali soluble composition comprises at least one acrylic terpolymer.

24. The method of claim 23, in which the acrylic terpolymer has an acid number in the range of about 90–95.

25. The method of claim 23, in which the coating composition comprises at least one acrylic copolymer and a polyurethane resin.

26. The method of claim 15, in which the alkali soluble composition is applied to a hydrophilic surface of the substrate.

27. The method of claim 15, in which the substrate surface is first provided with a hydrophilic layer by contacting a surface of the substrate with a liquid comprising a silicate solution in which particulate matter is dispersed, and the alkali soluble composition is thereafter applied to the hydrophilic layer.

28. The method of claim 15, in which the layer applied to the substrate face has a total weight in the range of 0.5–3 $mg/m^2$.

29. A method of printing comprising:

(a) providing a printing plate prepared by the process comprising:

(i) applying an alkali soluble composition comprising at least one polymer composition to a hydrophilic surface on a substrate to provide the surface with at least one layer which is alkali soluble at a pH in the range of about 6.0 to 14.0, (ii) imaging the coated substrate electrostatically with a toner composition, (iii) heating the imaged substrate a first time to a temperature greater than the glass transition temperature of the toner composition, (iv) contacting the imaged substrate with an aqueous alkaline solution having a pH in the range of about 6.0 to about 14.0, and (v) heating the imaged substrate a second time to a temperature greater than the glass transition temperature of the toner composition to provide an imaged printing plate;

(b) contacting the imaged printing plate with an ink; and (c) transferring imagewise the ink from the printing plate to a receiving material.

30. The printing plate of claim 1, wherein said toner composition has a glass transition temperature between about 70°–90° C.

31. The printing plate of claim 1, wherein the imaged substrate is contacted with the aqueous alkaline solution, thereby removing the non-imaged portions of the layer.

32. The method of claim 15, wherein said toner composition has a glass transition temperature between about 70°–90° C.

33. The method of claim 15, wherein the imaged substrate is contacted with the aqueous alkaline solution, thereby removing the non-imaged portions of the layer.

34. A printing plate prepared by a process comprising:

a) applying an alkali soluble composition comprising at least one polymer composition to a hydrophilic surface on a substrate to provide the surface face with at least one non-photoconductive layer which is alkali soluble at a pH in the range of about 6.0 to 14.0;

b) imaging the coated substrate electrostatically with a toner composition;

c) heating the imaged substrate a first time to a temperature greater than the glass transition temperature of the toner composition;

d) contacting the imaged substrate with an aqueous alkaline solution having a pH in the range of about 6.0 to about 14.0; and e) heating the imaged substrate a second time to a temperature greater than the glass transition temperature of the toner composition.

35. A method of preparing a printing plate comprising:

a) applying an alkali soluble composition comprising at least one polymer composition to a hydrophilic surface on a substrate to provide the surface face with at least one non-photoconductive layer which is alkali soluble at a pH in the range of about 6.0 to 14.0;

b) imaging the coated substrate electrostatically with a toner composition;

c) heating the imaged substrate a first time to a temperature greater than the glass transition temperature of the toner composition;

d) contacting the imaged substrate with an aqueous alkaline solution having a pH in the range of about 6.0 to about 14.0; and e) heating the imaged substrate a second time to a temperature greater than the glass transition temperature of the toner composition.

36. A method of printing comprising:

a) providing a printing plate prepared by the process comprising:

i) applying an alkali soluble composition comprising at least one polymer composition to a hydrophilic surface on a substrate to provide the surface with at least one non-photoconductive layer which is alkali soluble at a pH in the range of about 6.0 to 14.0, ii) imaging the coated substrate electrostatically with a toner composition, iii) heating the imaged substrate a first time to a temperature greater than the glass transition temperature of the toner composition, iv) contacting the imaged substrate with an aqueous alkaline solution having a pH in the range of about 6.0 to about 14.0, and v) heating the imaged substrate a second time to a temperature greater than the glass transition temperature of the toner composition to provide an imaged printing plate;

b) contacting the imaged printing plate with an ink; and c) transferring imagewise the ink from the printing plate to a receiving material.

37. A printing plate prepared by a process comprising:

a) applying an alkali soluble composition comprising at least one polymer composition to a hydrophilic surface on a substrate to provide the surface face with a coating which is alkali soluble;

b) imaging the coated substrate electrostatically with a toner composition;

c) contacting the imaged substrate with an aqueous alkaline solution, thereby removing the non-imaged portion of the coating; and d) heating the imaged substrate to a temperature greater than the glass transition temperature of the toner composition, thereby fixing the remaining toner and underlying coating to the substrate.

38. A method of preparing a printing plate comprising:

a) applying an alkali soluble composition comprising at least one polymer composition to a hydrophilic surface on a substrate to provide the surface face with a coating which is alkali soluble;

b) imaging the coated substrate electrostatically with a toner composition;

c) contacting the imaged substrate with an aqueous alkaline solution, thereby removing the non-imaged portion of the coating; and d) heating the imaged substrate to a temperature greater than the glass transition temperature of the toner composition, thereby fixing the remaining toner and underlaying coating to the substrate.

39. A method of printing comprising:

a) providing a printing plate prepared by the process comprising:

i) applying an alkali soluble composition comprising at least one polymer composition to a hydrophilic surface on a substrate to provide the surface with a coating which is alkali soluble, ii) imaging the coated substrate electrostatically with a toner composition, iii) contacting the imaged substrate with an aqueous alkaline solution, thereby removing the non-imaged portion of the coating, and iv) heating the imaged substrate to a temperature greater than the glass transition temperature of the toner composition to provide an imaged printing plate, thereby fixing the remaining toner and underlying coating to the substrate;

b) contacting the imaged printing plate with an ink; and c) transferring imagewise the ink from the printing plate to a receiving material.

* * * * *